US005612595A

United States Patent [19]

Maheshwari

[11] Patent Number: 5,612,595

[45] Date of Patent: Mar. 18, 1997

[54] ELECTRONIC DIMMING BALLAST CURRENT SENSING SCHEME

[75] Inventor: Ajay Maheshwari, Dallas, Tex.

[73] Assignee: C-P-M Lighting, Inc., San Leandro, Calif.

[21] Appl. No.: 528,507

[22] Filed: Sep. 13, 1995

[51] Int. Cl.[6] ..... G05F 1/00

[52] U.S. Cl. ..... 315/291; 315/224; 315/200 R; 315/205; 315/DIG. 4; 315/DIG. 5; 315/DIG. 7

[58] Field of Search ..... 315/209 R, 219, 315/224, 226, 229, 235, 291, 307, DIG. 4, DIG. 5, DIG. 7, 205, 302

[56] References Cited

U.S. PATENT DOCUMENTS

| | | | |
|---|---|---|---|
| 4,251,752 | 2/1981 | Stolz | 315/206 |
| 4,392,087 | 7/1983 | Zansky | 315/219 |
| 5,001,386 | 3/1991 | Sullivan et al. | 315/219 |
| 5,041,763 | 8/1991 | Sullivan et al. | 315/176 |
| 5,049,790 | 9/1991 | Herfurth et al. | 315/291 |
| 5,066,894 | 11/1991 | Klier | 315/224 |
| 5,144,205 | 9/1992 | Motto et al. | 315/244 |
| 5,172,034 | 12/1992 | Brinkerhoff | 315/307 |
| 5,173,643 | 12/1992 | Sullivan et al. | 315/276 |
| 5,331,253 | 7/1994 | Counts | 315/209 R |
| 5,422,546 | 6/1995 | Nilssen | 315/219 |
| 5,424,611 | 6/1995 | Moriarty, Jr. | 315/224 X |
| 5,424,614 | 6/1995 | Maheshwari | 315/209 R |
| 5,500,576 | 3/1996 | Russell et al. | 315/307 |

OTHER PUBLICATIONS

A. Okuda, "Development of an Elecytronic Dimming Ballast . . . ", Journal of Ill. Eng. Soc., Winter 1992.

*Primary Examiner*—Robert Pascal
*Assistant Examiner*—Haissa Philogene
*Attorney, Agent, or Firm*—Law Offices of Thomas E. Schatzel A Prof. Corporation

[57] ABSTRACT

A dimmable fluorescent lamp system embodiment of the present invention comprises a fluorescent lamp with filaments at each end that are continuously heated by independent secondary windings of a transformer. A resonating capacitor is connected in series with a resonating inductor and a pair of DC blocking capacitors are connected from each end of the fluorescent lamp to put it in parallel with the resonating capacitor. A control logic drives the primary winding with a pulse-width or frequency modulated square wave that is controlled by a feedback voltage derived from a pair of rectifiers and a dropping resistor in series with one of the DC blocking capacitors.

6 Claims, 3 Drawing Sheets

ELECTRONIC DIMMING BALLAST CURRENT SENSING SCHEME

BACKGROUND OF THE INVENTION

1. Field of the Invention

The present invention relates generally to fluorescent lamps, and more specifically to lamp systems with wide-range dimming adjustments.

2. Description of the Prior Art

Fluorescent lamps provide high efficiency operation and long life. However, fluorescent lamps require ballasts that convert the operating voltages and regulate the current delivered to the lamps themselves. Traditional ballasts have only offered on and off operation, fluorescent lamps with dimming capability have been rare. Electronic ballasts with dimming capability form the basis of highly efficient energy and lighting management systems. Conventional lamp systems with dimming ranges that can go as low as 20% of the maximum light output use both magnetic and electronic dimming ballasts. High frequency electronic ballasts have extended the lower dimming range limit to as low as one percent of maximum and are becoming increasingly affordable and popular. Essentially, fluorescent dimming circuits control the lamp current.

Because fluorescent lamps have very nonlinear electrical characteristics, such dimming controls are not as simple as they are for incandescent lamps which require only simple variable resistors, for example. Dimming down to twenty percent with conventional fluorescent lamp ballasts can be done without using a special feed-back control. However, for more extended lower dimming ranges, some sort of feed-back control becomes necessary to avoid lamp flicker and unstable lamp operation. Lamp power and lamp current are each typically used as control variables in the implementation of a feed-back control circuit. Where the lamp light output or lamp power is used as the control variable, the dimming range that can be realized is limited. For very extended low-end dimming levels, sensing the lamp arc current becomes essential.

Dimming operation requires that the lamps be operated with their filaments heated. Each filament at the respective lamp ends will draw a heating current and an arc current that flows between the filament ends when a sufficiently high voltage is applied.

The fluorescent lamp arc current is a differential current between the filaments that can be measured by a current transformer in series with the high voltage supply. In conventional dimming ballasts, the output voltage of such a current transformer is rectified and converted to a DC voltage that is proportional to the arc current. The DC voltage is used in a feedback control to regulate the arc current. The ratio of full-bright current at maximum light output and full-dim current at minimum light output typically ranges from 20:1 to 100:1, depending on the fluorescent lamps and ballasts used. Often the feedback voltages that represent the full-dim current become too small to rectify from AC to DC and require more complex and elaborate conversion circuitry. Precision current transformers themselves are relatively expensive and the overall cost of conventional current sensing becomes prohibitive.

Pat. No. 5,424,614 for "Modified Half-Bridge Parallel-Loaded Series Resonant Converter Topology For Electronic Ballast," describes an output topology that enables the sensing of lamp arc current without adding magnetic components (current transformers) or any elaborate circuitry.

SUMMARY OF THE PRESENT INVENTION

It is therefore an object of the present invention to provide a dimmable fluorescent lamp system that enables the sensing of lamp arc current without adding magnetic components, such as current transformers, or other elaborate circuitry.

It is a further object of the present invention to provide a dimmable fluorescent lamp system with a wide range of light dimming.

Briefly, a dimmable fluorescent lamp system embodiment of the present invention comprises a fluorescent lamp with filaments at each end that are continuously heated by a transformer. A resonating capacitor is connected in series with a resonating inductor and a pair of DC blocking capacitors are connected from each end of the fluorescent lamp to put it in parallel with the resonating capacitor. A control logic drives the primary winding with a pulse-width or frequency modulated square wave that is controlled by a feedback voltage derived from a pair of rectifiers and a dropping resistor in series with one of the DC blocking capacitors.

An advantage of the present invention is that a fluorescent lamp system is provided that is economical to manufacture.

Another advantage of the present invention is that a fluorescent lamp system is provided that has a wide range of light dimming.

These and other objects and advantages of the present invention will no doubt become obvious to those of ordinary skill in the art after having read the following detailed description of the preferred embodiments which are illustrated in the various drawing figures.

IN THE DRAWINGS

DETAILED DESCRIPTION OF THE PREFERRED EMBODIMENT

Figure 1A:
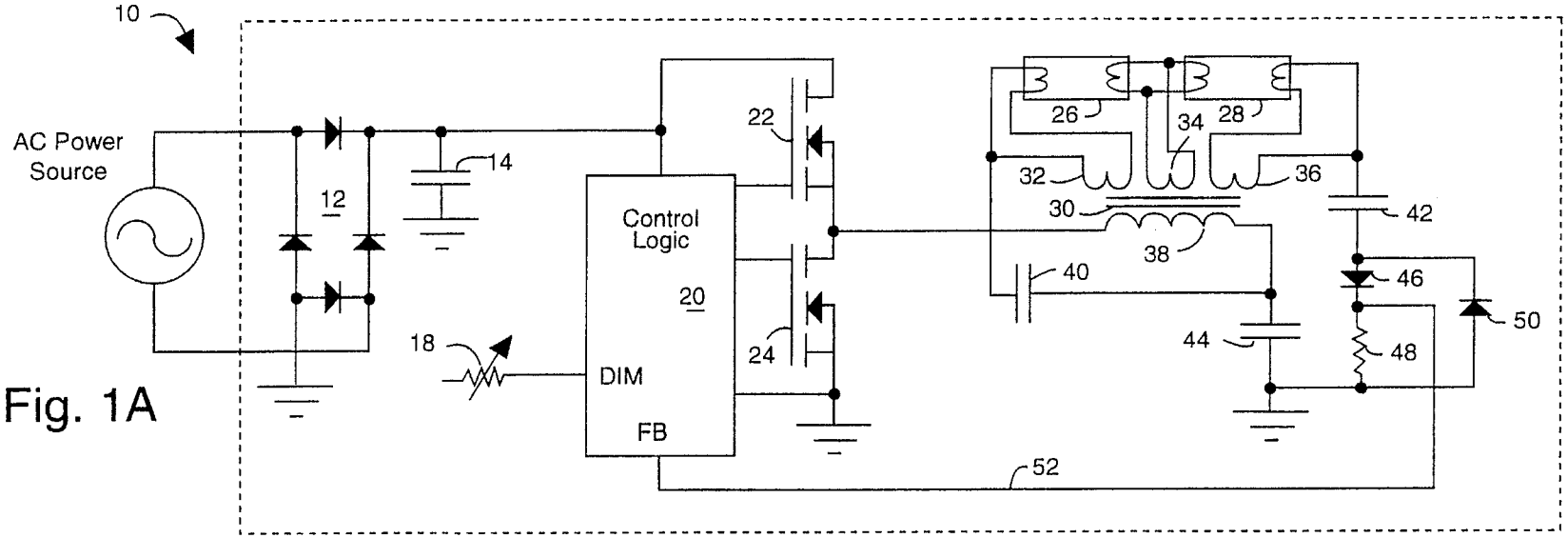
FIG. 1A is a schematic diagram of a fluorescent lamp system embodiment of the present invention with two DC blocking capacitors for safety and two dimmable fluorescent lamps.
Figure 1B:
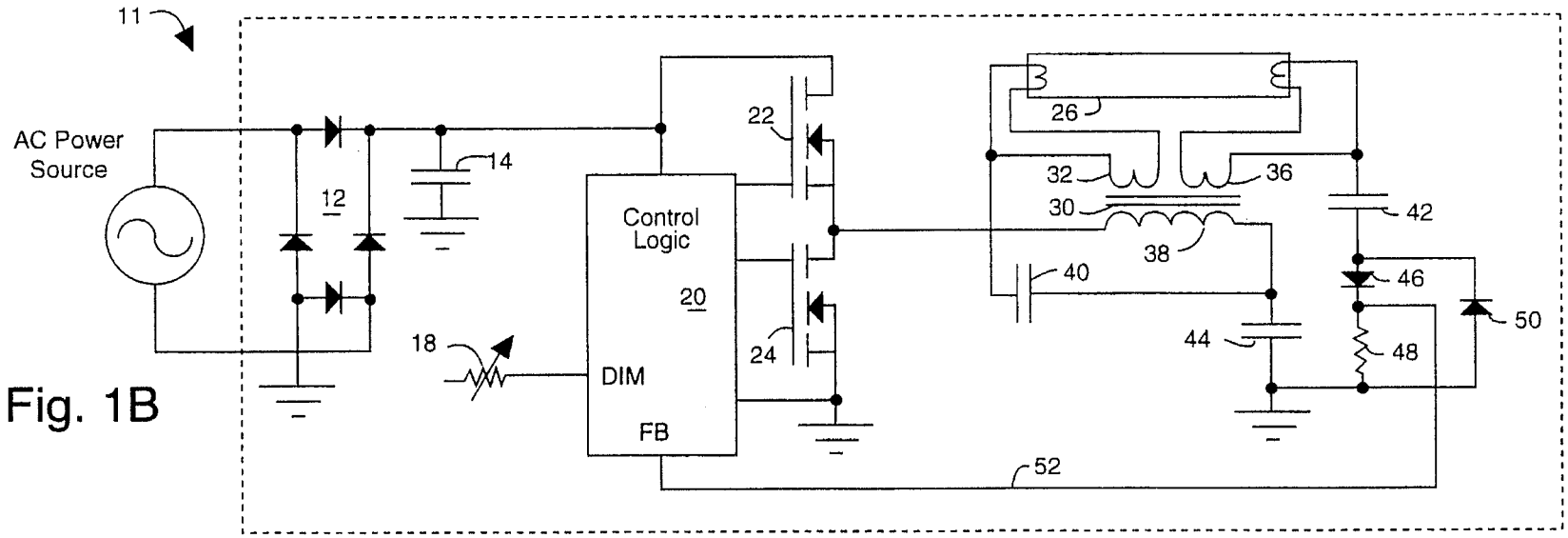
FIG. 1B is a schematic diagram of a fluorescent lamp system embodiment of the present invention with two DC blocking capacitors for safety and one dimmable fluorescent lamp.
Figure 2A:
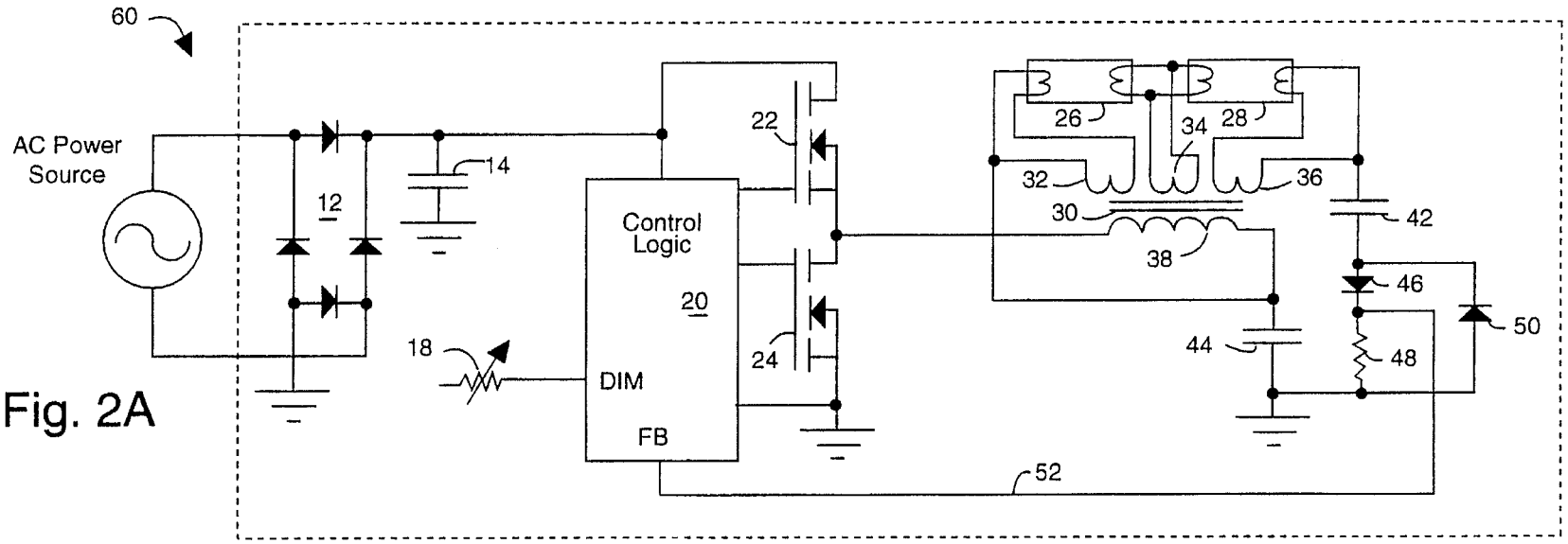
FIG. 2A is a schematic diagram of a fluorescent lamp system embodiment of the present invention with one DC blocking capacitor in a current sensing leg and two dimmable fluorescent lamps.
Figure 2B:
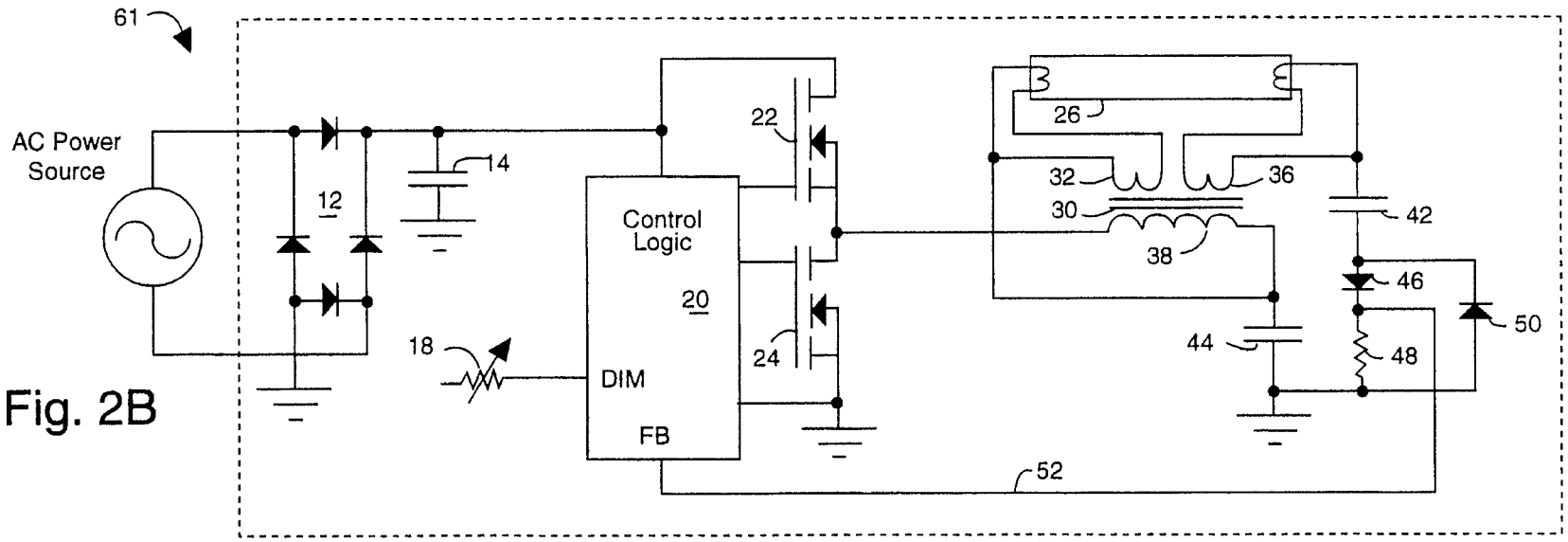
FIG. 2B is a schematic diagram of a fluorescent lamp system embodiment of the present invention with one DC blocking capacitor in a current sensing leg and one dimmable fluorescent lamp.
Figure 3A:
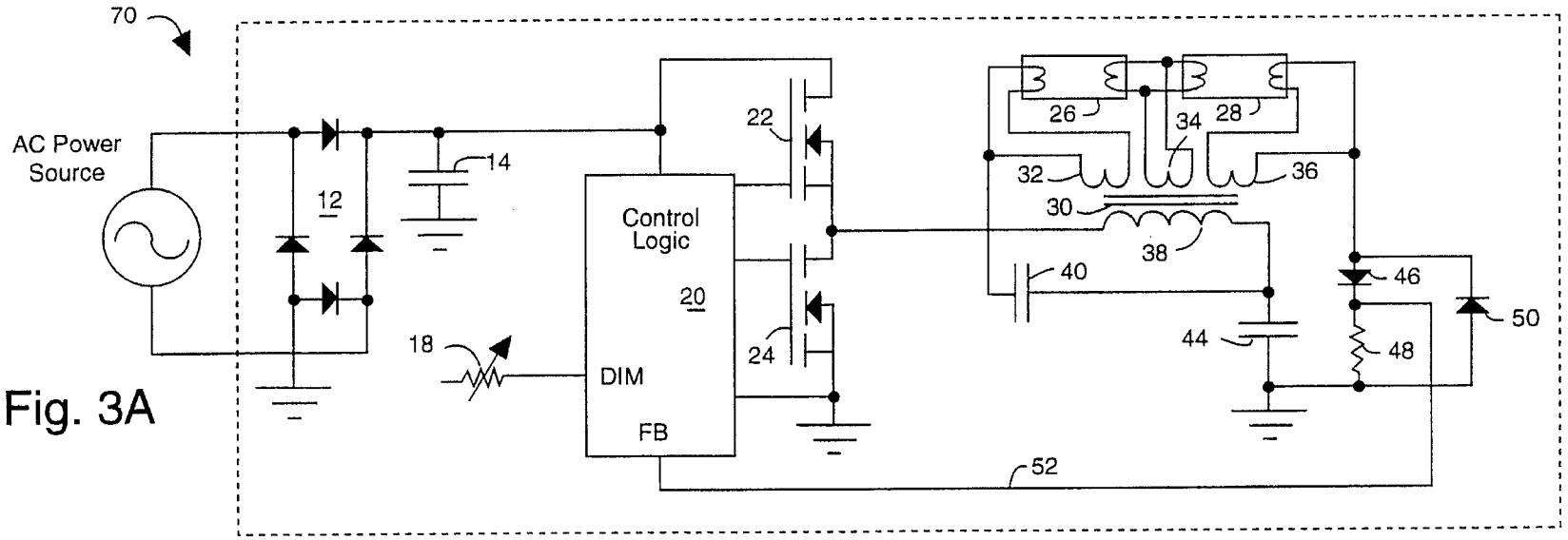
FIG. 3A is a schematic diagram of a fluorescent lamp system embodiment of the present invention with one DC blocking capacitor and two dimmable fluorescent lamps.
Figure 3B:
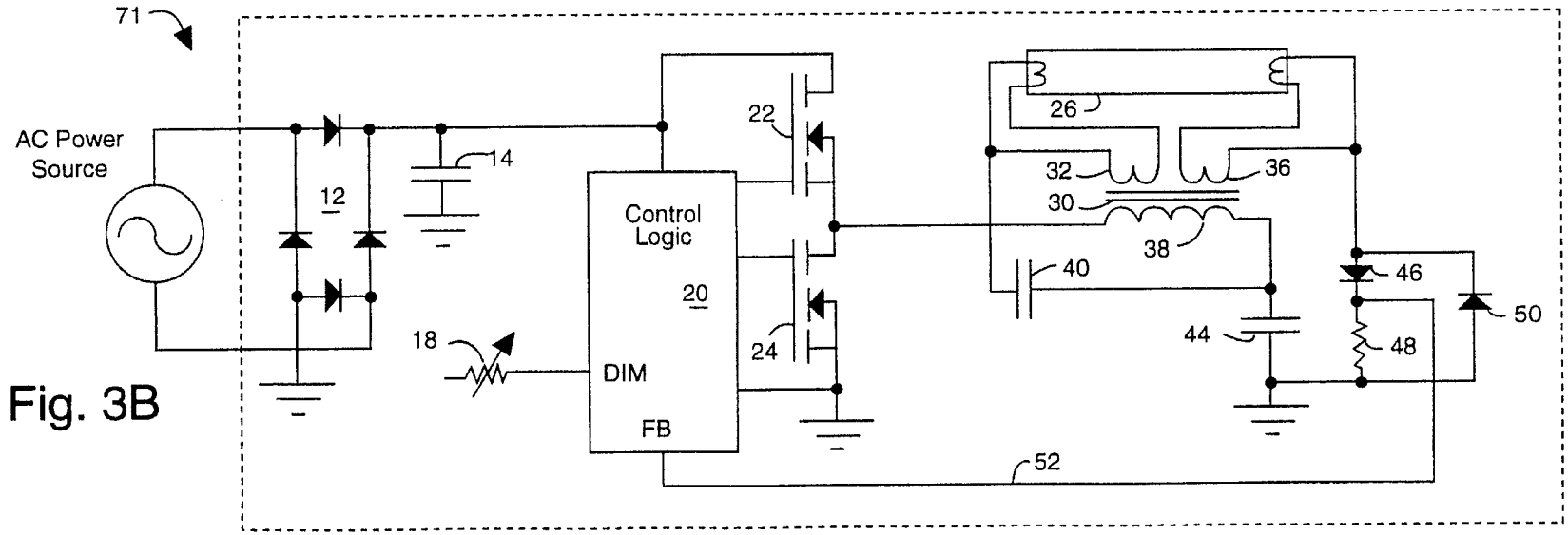
FIG. 3B is a schematic diagram of a fluorescent lamp system embodiment of the present invention with one DC blocking capacitor and one dimmable fluorescent lamp.

FIGS. 1A and 1B illustrate similar dimmable fluorescent lamp system embodiments of the present invention referred to herein by the general reference numerals 10 and 11. Each system 10 and 11 comprises a full-wave rectifier 12 for converting an incoming AC line voltage to DC. A capacitor 14 smooths the rectified PC. A dimming control 18 provide inputs to a control logic 20 that pulse-width or frequency modulates a pair of power transistors 22 and 24 in totem-pole configuration. The dimming control 18 allows a user to set the light output of the systems 10 and 11 to a continuously variable point between a minimum and a maximum level, e.g., 1% to 100%. The system 10 (FIG. 1A) uses a pair of fluorescent lamps 26 and 28, while the system 11 (FIG. 1B) uses only the single fluorescent lamp 26. A transformer 30 provides independent secondary windings 32 (FIGS. 1A and 1B), 34 (FIG. 1A only) and 36 (FIGS. 1A and 1B) for providing continuous heating of the filaments in the respective ends of the lamps 26 and 28. A primary winding 38 is connected to the junction of the power transistors 22 and 24.

The primary winding of the inductor serves as a resonating inductor, and could be substituted by a discrete inductor apart from a filament heating transformer. A DC blocking capacitor 40 couples high voltage AC to the secondary winding 32. Another DC blocking capacitor 42 couples the opposite polarity of the high voltage AC to the secondary winding 36. A resonating capacitor 44 is in series with the primary winding 38 and develops a sufficiently high voltage to create and sustain an arc current between the filaments of the lamps 26 and 28 (FIG. 1A), or the lamp 26 only (FIG. 1B), when the square-wave frequency produced by the control logic 20 is right.

Dimming feedback control is provided by a rectifier 46 that produces a positive DC voltage drop through a sensing resistor 48. A rectifier 50 completes the AC circuit for the arc current that does not pass through the rectifier 46. A feedback voltage that is absent the usual diode voltage drop is connected by a line 52 to the control logic 20. The control logic 20 uses a setpoint of operation established by the dimming control 18 to vary the switching duty-cycle and/or switching frequency of the power transistors 22 and 24 such that the voltage on line 52 serves into some corresponding level in a closed-loop control scheme. The resistance value of the sensing resistor 48 can neither be too large or too small, so ten to fifty ohms has proven to be acceptable.

The DC blocking capacitors 40 and 42 are both not necessary. Having both provides some safety to the user by limiting the current to the earth ground from the AC power source. Either DC blocking capacitor 40 or 42 can be replaced by a wire connection, as are respectively illustrated in FIGS. 2A, 2B, 3A and 3B for lamp systems designated by the general reference numerals 60, 61, 70 and 71. In all other respects, lamp systems 60, 61, 70 and 71 correspond to lamp systems 10 and 11, and so use the same element numbers as in FIGS. 1A and 1B.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A dimmable fluorescent lamp system, comprising:

a first fluorescent lamp with first and second filaments at respective opposite ends for continuous heating;

a resonating inductor with first and second ends;

a resonating capacitor with first and second ends connected in series with said second end of the resonating inductor;

a connection from said first filament to a junction of said second end of the resonating inductor and said first end of the resonating capacitor;

a dropping resistor and a first rectifier connected in series with a DC blocking capacitor between said second filament and said first end of the resonating capacitor with a second rectifier connected with opposite polarity across said dropping resistor and said first rectifier, wherein a feedback voltage is developed across said dropping resistor that is proportional to an arc current flowing through the fluorescent lamp between said first and second filaments; and a control logic connected to receive said feedback voltage from said dropping resistor and connected to drive said first end of the inductor with a pulse-width or frequency modulated square wave that is controlled over a dimming range by said feedback voltage.

2. The system of claim 1, further comprising:

a second fluorescent lamp connected in series with the first fluorescent lamp and having heating filaments in opposite ends; and a transformer for heating said filaments in the first and second fluorescent lamps;

wherein a single arc current flows through the series combination of the first and second fluorescent lamps and said dropping resistor and providing for a dimming control of both the first and second fluorescent lamps.

3. A dimmable fluorescent lamp system, comprising:

a first fluorescent lamp with first and second filaments at respective opposite ends for continuous heating;

a resonating inductor with first and second ends;

a resonating capacitor with first and second ends connected in series with said second end of the resonating inductor;

a DC blocking capacitor connected from said first filament to a junction of said second end of the resonating inductor and said first end of the resonating capacitor;

a dropping resistor and a first rectifier connected in series between said second filament and said first end of the resonating capacitor with a second rectifier connected with opposite polarity across said dropping resistor and said first rectifier, wherein a feedback voltage is developed across said dropping resistor that is proportional to an arc current flowing through the fluorescent lamp between said first and second filaments; and a control logic connected to receive said feedback voltage from said dropping resistor and connected to drive said first end of the inductor with a pulse-width or frequency modulated square wave that is controlled over a dimming range by said feedback voltage.

4. The system of claim 3, further comprising:

a second fluorescent lamp connected in series with the first fluorescent lamp and having heating filaments in opposite ends; and a transformer for heating said filaments in the first and second fluorescent lamps;

wherein a single arc current flows through the series combination of the first and second fluorescent lamps and said dropping resistor and providing for a dimming control of both the first and second fluorescent lamps.

5. A dimmable fluorescent lamp system, comprising:

a first fluorescent lamp with first and second filaments at respective opposite ends for continuous heating;

an inductor with a pair of independent secondary windings respectively connected to said first and second filaments;

a resonating inductor with first and second ends;

a resonating capacitor with first and second ends connected in series with said second end of the resonating inductor;

a first DC blocking capacitor connected from said first filament to a junction of said second end of the resonating inductor and said first end of the resonating capacitor;

a second DC blocking capacitor connected in series with a dropping resistor and a first rectifier between said second filament and said first end of the resonating capacitor with a second rectifier connected with opposite polarity across said dropping resistor and said first rectifier, wherein a feedback voltage is developed across said dropping resistor that is proportional to an arc current flowing through the fluorescent lamp between said first and second filaments; and a control logic connected to receive said feedback voltage from said dropping resistor and connected to drive said first end of the inductor with a pulse-width or frequency modulated square wave that is controlled over a dimming range by said feedback voltage.

6. The system of claim 5, further comprising:

a second fluorescent lamp connected in series with the first fluorescent lamp and having heating filaments in opposite ends; and a third secondary winding on the inductor for heating said filaments in the first and second fluorescent lamps;

wherein a single arc current flows through the series combination of the first and second fluorescent lamps and said dropping resistor and providing for a dimming control of both the first and second fluorescent lamps.

* * * * *